United States Patent [19]

Wang: Willington L. T.

[11] Patent Number: 4,972,392

[45] Date of Patent: Nov. 20, 1990

[54] TIME CONVERSION CLOCK

[76] Inventor: Wang: Willington L. T., 5F, No. 59-4, Lane 42, Ming Chuan Road, Hsin Tien, Taipei, Taiwan

[21] Appl. No.: 364,070

[22] Filed: Jun. 8, 1989

[51] Int. Cl.[5] ..... G04B 19/22

[52] U.S. Cl. ..... 368/21; 368/25; 368/27

[58] Field of Search ..... 368/21–27

[56] References Cited

U.S. PATENT DOCUMENTS

| | | | |
|---|---|---|---|
| 975,877 | 11/1910 | Law | 368/21 |
| 1,153,492 | 9/1915 | Hoijinga | 368/27 |
| 2,024,066 | 12/1935 | Segova | 368/25 |
| 2,144,922 | 1/1939 | Jacobs | 368/27 |
| 2,635,414 | 4/1953 | Cettier | 368/21 |
| 3,226,926 | 1/1966 | Kilburg | 368/25 |
| 3,918,251 | 11/1975 | Wakabatashi | 368/25 |

FOREIGN PATENT DOCUMENTS

| | | | |
|---|---|---|---|
| 2072 | 9/1953 | United Kingdom | 360/25 |

*Primary Examiner*—Vit W. Miska

*Attorney, Agent, or Firm*—Bucknam and Archer

[57] ABSTRACT

A time conversion universal clock includes a time conversion transmission mechanism having one output connected with a time recording element, and another output coupled with a universal time zone map, so that the time recording element drives the universal time zone map in a counter-clockwise direction of rotation. The universal time zone map displays at least some of the world's geographical regions in a polar projection in terms of time zones corresponding thereto. A time conversion transmission mechanism of the time conversion universal clock has a rotary input at a first rotation rate, and provides a rotary output at a second rotation rate; the ratio of the first to the second rotation rates is defined as a transmission ratio, which is made equal to 0.5 by two pulleys, or, alternately gearwheels, of a coupling device of the time conversion mechanism, which engage one another, and have a diameter ratio of two. The hour hand of the universal clock thus covers 12 hours in one turn, while the universal time zone map covers the same 12 hours in half a turn. In an alternate embodiment, the geographical regions are shown stationary in a Mercator projection, while the moving time-indicating numerals are juxtaposed with the respective geographical regions and time zones corresponding thereto. Time for a respective time zone, and optionally for the geographic region corresponding to that time zone is displayed by the stationary geographic regions and time zones corresponding thereto being juxtaposed with the corresponding moving numeral.

8 Claims, 4 Drawing Sheets

TIME CONVERSION CLOCK

BACKGROUND OF THE INVENTION

In ancient times, people were recording the time according to the natural phenomenon of the ascent and descent of the sun and of the moon. However, the change of the natural phenomenon of the ascent and descent of the sun and of the moon may vary with the change of season, location, and weather.

It is an outstanding achievement in human history to have quantitatively divided a day into 24 hours, an hour into 60 minutes, and a minute into 60 seconds, and to have divided the world into 24 time zones. As a consequence, the application of time conversion helps in deciding at which times to set up communication between two areas in the world, which are remote from one another.

Following the fast development in transportation and telecommunication, the land we live on has become a small world. An event which happens at one place may be instantly transmitted and noticed by people who live in another continent. In order to meet actual requirements in daily affairs, time conversion has become more and more important.

The conventional method to display the time for specific time zones, as commonly adopted by international standard hotels, is to display the time for respective time zones on several wall clocks simultaneously.

Recently there has become known a kind of table clock for a time conversion display, which includes a base having a plurality of time recording elements to display the time for a respective time zone. However, this kind of time conversion clock is not very satisfactory in application, and has various drawbacks, as outlined hereinunder:

(1) It is heavy and expensive. Because is requires several time recording elements, its size and manufacturing cost cannot easily be minimized.

(2) It provides only a limited time display. Because it can only display time for a limited number of time zones, it cannot be regarded as a "universal clock".

(3) It is difficult to regulate and maintain. Because it includes various time recording elements, its regulation and maintenance process becomes more complicated and cumbersome.

SUMMARY OF THE INVENTION

The present invention provides a time conversion clock, and more particularly one which includes a time recording element so as to drive, in one embodiment, a crossed belt, which in turn causes a time conversion world map to rotate, simultaneously with the clockwise rotation of the time conversion clock, in a counterclockwise direction for a complete range of time displays, covering a total of 24 time zones.

The objects, features, and advantages of the present invention will be more fully understood from the following detailed description considered in conjunction with the annexed drawings.

DETAILED DESCRIPTION OF THE PREFERRED EMBODIMENTS

Figure 1:
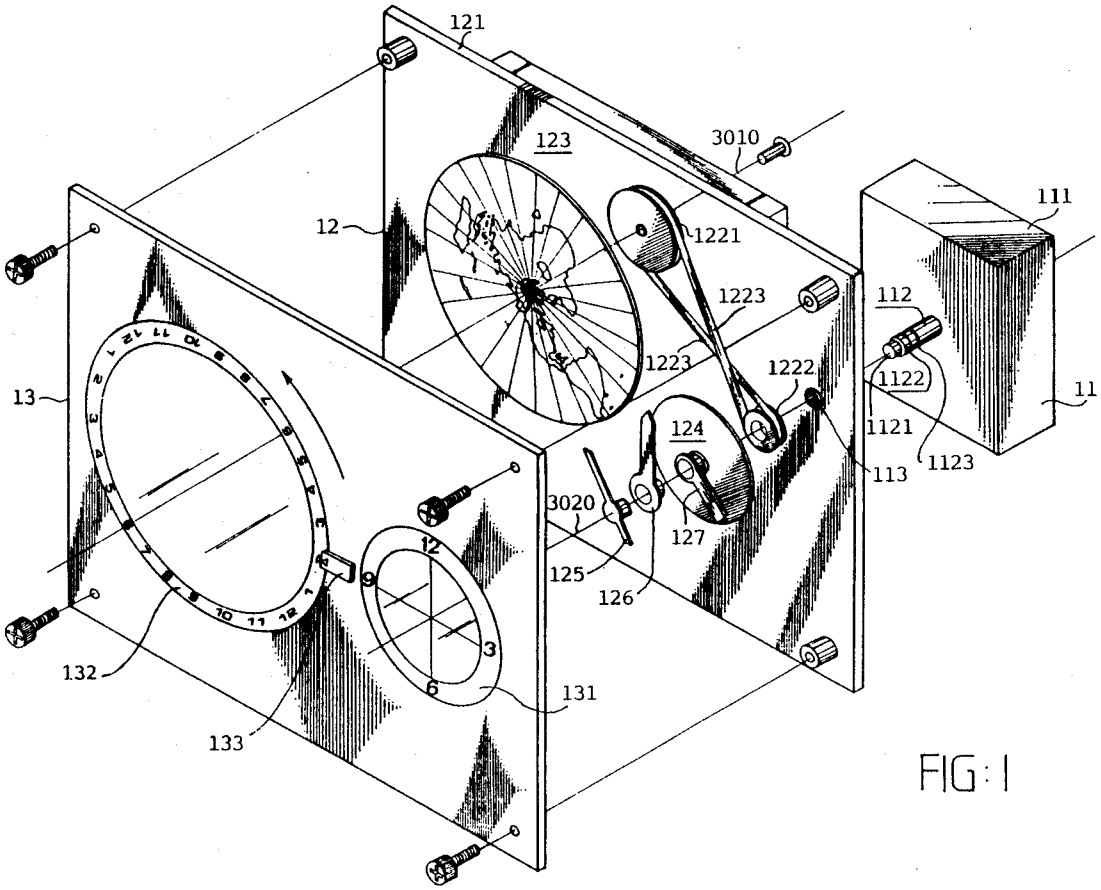
FIG. 1 is a perspective, fragmentary view of a time conversion clock embodying one preferred embodiment of the present invention.

Referring to FIG. 1, a time conversion clock includes a core (11), a base panel (12) and a front panel (13) in first embodiment thereof.

The core (11) is the heart of the clock, which is a battery operated time recording element, as commonly used in a conventional alarm clock, so as to drive the clock, and includes a housing (111) having a battery power supply, a quartz crystal contained therein, and an arbor (112) mounted thereon, which arbor (112) includes an outer staff (1121), an intermediate staff (1122), and an inner staff (1123). When the core (11) is mounted on the base panel (12) with the arbor (112) inserted through an axial aperture or hole (113) of the base panel (12), the seconds hand (125), the minute hand (126), and the hour hand (127) are respectively mounted on the outer, the intermediate, and the inner staffs (1121), (1122) and (1123), so as to follow the respective staffs in rotation.

The base panel (12) includes a flat plate (121) provided with a two-axle time conversion transmission means, i.e. a device operatively accepting a rotary input at a first rotation rate about a first axis, and providing a rotary output at a second rotation rate about a second axis, and where the ratio of these rotation rates is referred to as the "transmission ratio".

In the embodiment described hereinafter, the time conversion transmission means includes a time conversion belt pulley set (122), a universal time zone map disc (123), a circular division plate (124), the seconds hand (125), the minute hand (126) and the hour hand (127). The universal time zone map disc (123) shows at least some of the world's geographic regions in a polar projection in terms of the respective time zones corresponding thereto.

The time conversion belt pulley set (122) includes rotary input means defining a first center, such as a driving pulley (1222) mounted on a shaft (3010), rotary output means defining a second center, such as a big driven pulley (1221) mounted on a shaft or axle (3020), the latter two shafts being symbolically indicated only by respective lines, and coupling means in the form of a crossed belt (1223) in driving relationship with the pulleys (1221) and (1222). The big driven pulley (1221) has a circumference twice that of the small driving pulley (1222), that is, when the small driving pulley (1222) revolves for one turn in one direction, the big driven pulley (1221) will be driven to rotate in an opposite direction for half-a-turn. Thus a transmission ratio of 0.5 is defined between the outer hour staff (1122), or the small driving pulley (1222) on one hand, and the large driven pulley (1221), or the universal time zone map disc (123), on the other hand. When the core (11) is mounted on the base panel (12) at its back side, the arbor (112) passes through the hole or aperture (113) in the base panel (12) for mounting thereon the small driving pulley (1222) and the circular division plate (124) in proper sequence; these components are arranged at equal respective distances from one another.

Thus the seconds hand (125), the minute hand (126), and the hour hand (127) can be respectively connected to the outer staff (1123), the intermediate staff (1122), and the inner staff (1121).

Therefore, when the arbor (12) of the core (11) is revolving, the seconds hand (125), the minute hand (126), the hour hand (127), and the time conversion belt pulley set (122) will be driven to rotate also, but at different respective rotation rates.

The big driven pulley (1221), which in turn is revolvably mounted on the base panel (12) at its front side for connection thereon to the universal time zone map disc (123), for example by means of a rivet connection, is driven by the small driving pulley (1222) through the crossed belt (1223) in a sense opposite to that of the small driving pulley (1222) at a revolving speed one half that of the small driving pulley (1222), that is, when the hour staff (1121) revolves clockwise for one turn (12 hours), the big driven pulley (1221) will revolve counter-clockwise for half a turn. Therefore, when the core (11) starts to run, the universal time zone map in the form of a flat circular disc (123) will be carried along, so as to rotate simultaneously therewith.

The front panel (13) is also a flat board, having a stationary dial plate (131) mounted thereon to match, or be coaxially aligned with the time zone map disc (123), and with the seconds hand, the minute hand, and the hour hand for a time indication; a time ring (132) revolvably mounted on the front panel (13) is disposed near a side of the dial plate (131), and is coaxially aligned with the time zone map disc (123), and with the seconds hand, the minute hand, and the hour hand for time indication.

It will be noted that the center of the pulley (1222) is spaced at a predetermined distance from the center of the pulley (1221), which corresponds to the spacing of the center of the dial plate (131) to the center of the time ring (132).

An indicator pin (133) positioned between the dial plate (131) and the time ring (132) serves as an indication of relative setting of the latter with respect to the former; the numerical sequence of the time indicating numerals displayed on the time ring (132) is arranged in a counter-clockwise sequence in ascending order.

When all of the aforesaid component parts have been properly assembled, the operation of the core or time element (11) will drive the seconds, minute and hour hands, respectively, to indicate local time through the dial plate (131), and the time conversion belt pulley set (122) will simultaneously be driven to rotate, so as to drive the universal time zone map disc (123), which has at least some of the world's regions, and respective time zones shown thereon, to revolve in a counter-clockwise sense.

Thus when local time is indicated by the hour (127), minute (126), and seconds (125) hands, the time in a respective time zone will be indicated continuously by a respective moving time zone being juxtaposed with a corresponding time-indicating numeral on the periphery of the normally stationary time ring (132), but as it is revolvably mounted on the front plate (13) may be angularly set or adjusted.

Figure 2:
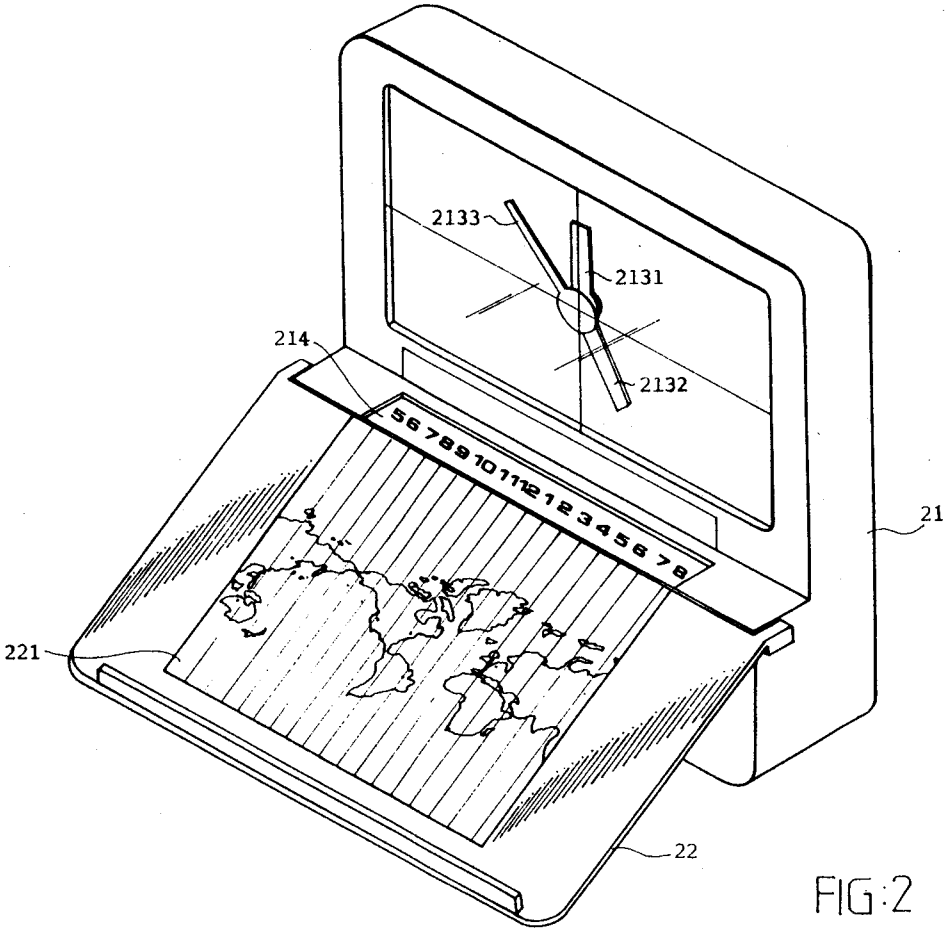
FIG. 2 is a perspective view of another preferred embodiment according to the present invention.
Figure 3:
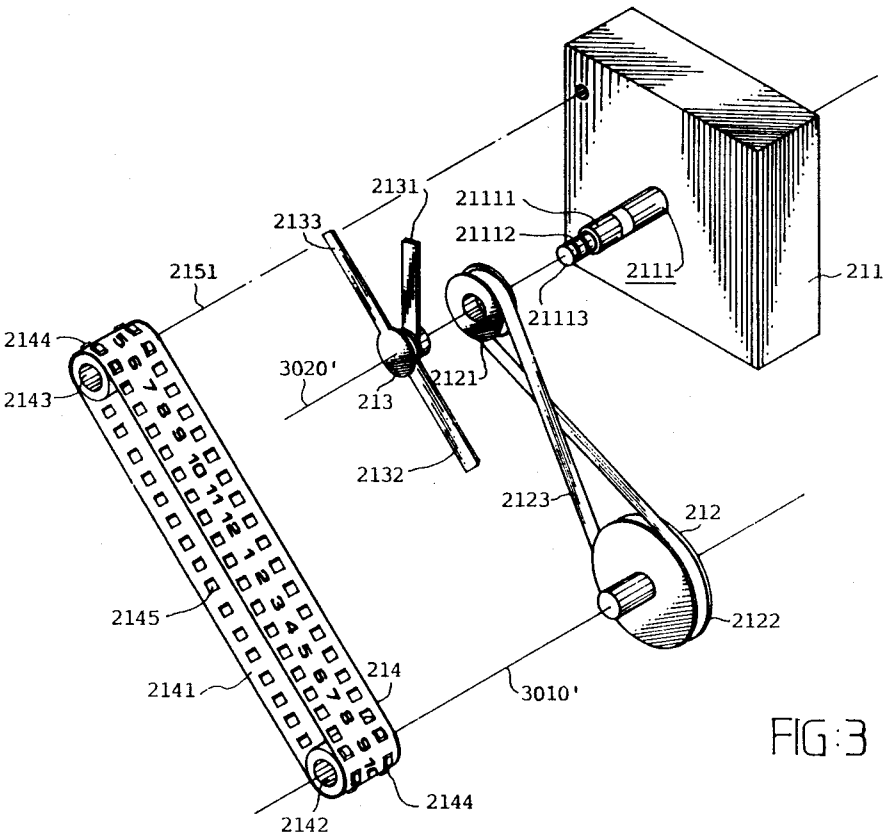
FIG. 3 is a schematic drawing in perspective of the driving mechanism used in the embodiment of FIG. 2.
Figure 4:
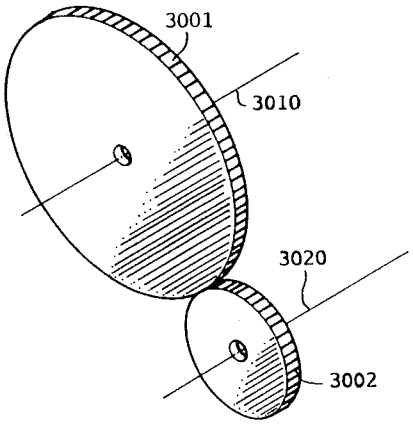
FIG. 4 is an alternate embodiment of the coupling means of the time conversion clock shown in FIG. 1.

FIGS. 2 and 3 illustrate a rotary type time conversion clock constructed according to the present invention. Basically, this embodiment as shown in FIG. 2 includes a body portion (21), and a universal time zone plate (22) extending therefrom in a plane which is transverse to the normally vertically extending main plane of the body portion (21).

The case-like body portion (21) includes a core (211) shown in FIG. 3, time conversion transmission means, such as a time conversion belt pulley set (212), a time hands set (213), and a rotary tape mechanism (214).

The core (211) is a conventional time recording element commonly used in a conventional alarm clock, having an arbor (2111), which in turn includes an hour staff (21111), a minute staff (21112), and a seconds staff (21113) for mounting thereon the time hands set (213).

The time conversion belt pulley set (212) includes a small pulley (2121) mounted on an extension shaft (3020) of the arbor (112), which is only symbolically indicated by a line, a big pulley (2122) mounted on a shaft or axis (3010) only symbolically indicated by a line, and coupling means in the form of a crossed belt (2133). The small pulley (2121) has a circumference one half the size of the big pulley (2121), and is mounted on the end of the arbor (2111), that is it rotates with the hour staff (21111) synchronously.

Therefore, when the hour staff (21111) is driven to rotate, the small pulley (2121) is driven to revolve for two turns (24 hours), while the big pulley (2122) is simultaneously driven to revolve for one turn (12 hours), i.e. the rotation rate of the big, or large pulley (2122) is 0.5 that of the rotation rate of the small pulley (2121), thus defining a transmission ratio of 0.5 between the small pulley (2121) and the large pulley (2122).

The time hands set (213) which defines a stationary and normally vertically extending plane, is mounted on the arbor (2111) of the core (211), and includes an hour hand (2131), a minute hand (2132), and a seconds hand (2133), with the hour hand (2131) connected to the hour staff (21111), the minute hand (2132) connected to the minute staff (21112), and the seconds hand (2133) connected to the seconds staff (21113).

The time zone rotary tape mechanism (214) includes an endless flat tape (2141) of a predetermined perimeter, which is mounted on a pair of hollow shafts (2143) and (2142), which hollow shafts (2142) and (2143) are respectively mounted on the shaft (3010) of the big pulley (2122), and a shaft or axle (2151) of the body portion (21), only symbolically indicated by a line. The endless flat tape (2141) is formed with bilateral perforations (2145) on two outer elongated portions thereof, and with a number series or time indicating numerals displayed on an elongated and continuous center portion thereof.

The driven hollow shaft (2142) and the hollow shaft (2143) have driving pins (2144) mounted on their cylindrical outer surfaces to engage the bilateral perforations (2145) of the endless flat tape (2141), so as to provide a universal conversion time display.

Referring specifically to FIG. 2 again, when the clock has been properly assembled, a non-labeled portion of the endless flat tape (2141) is disposed inside the case-like body portion (21), but an elongated center portion labeled with the numerical time series or time indicating numerals is partly displayed outside the body portion (21) for conversion time indication, and extends continuously in a plane, which is transverse to a main plane defined by the body portion (21).

The stationary universal time zone plate (22) is a flat board which projects from the body portion (21), and has a universal time zone map (221) shown thereon, with the time-indicating numerals of the endless flat tape (2141) of the time zone rotary tape mechanism (214) moving therealong. The universal time zone map (221), in turn, displays at least some of the world's geographic regions in terms of respective time zones corresponding thereto in a Mercatur projection.

When the core (211) starts to operate, the hour staff (21111) will be driven to induce the time conversion belt pulley set (212) to rotate, so as, in turn, to drive the endless tape (2141) of the time zone rotary tape mechanism (214). Because the time conversion belt pulley set (212) is driven by means of the crossed belt (2123), when the hour hand (2131) is driven to rotate clockwise, the endless tape (2141) will be driven to rotate counter-clockwise, that is, will circulate leftward. When the device is in operation, a moving time conversion table is presented by means of the time-indicating numerals on the operatively moving tape (2141) sliding past the stationary geographic map of the universal time zone plate (22).

Thus when the local time is indicated on the time hand set (213), the time in a respective time zone is indicated by means of a corresponding time numeral being at that time juxtaposed therewith, and juxtaposed also with the geographic region corresponding to that particular time zone.

As indicated, the structure described herein may have various embodiments. Recognizing that various modifications thereof will be apparent, the scope thereof shall be deemed to be defined by the claims as set forth below.

I claim:

1. A time conversion clock, comprising in combination a time recording element, an arbor projecting from, and being driven by said time recording element, a base panel, including a flat plate formed with an aperture, said arbor passing through said aperture, and including an outer hour staff, an intermediate minute staff, and an inner seconds staff, time conversion transmission means disposed on said flat plate, having rotary input means defining a first center, being concentrically coupled to said arbor, and operatively rotating at a first rotation rate about a first axis concentric with said arbor, rotary output means defining a second center, providing a rotary output at a second rotation rate about a second axis concentric with an axle, and coupling means coupling said rotary input means to said rotary output means, the ratio of said first to said second rotation rates being defined as a transmission ratio, said transmission ratio being 0.5, a universal time zone map in the form of an operatively rotating flat circular disc displaying at least some of the world's geographic regions in terms of respective time zones corresponding thereto, and being concentrically coupled to said rotary output means, the transmission ratio of said outer hour staff to said universal time zone map being equal to that of said time conversion transmission means, a circular division plate driven by said rotary input means, being coaxially aligned with an hour hand, a minute hand, and a seconds hand indicating time, respective of said hands being in driven connection with said outer hour staff, said intermediate minute staff, and said inner seconds staff, a flat front panel having a stationary dial plate mounted thereon, and being coaxially aligned with said circular division plate, and a time ring revolvably mounted on said flat front panel near said dial plate, said time ring being coaxially aligned with said universal time zone map, and showing on a circular periphery thereof time-indicating numerals in ascending order, as seen in an anti-clockwise sense, whereby, when local time is shown by said time-indicating hands on said dial plate, the time in a respective operatively moving time zone is continuously indicated thereon by the last-named time zone being juxtaposed with a corresponding stationary time-indicating numeral on said time ring.

2. A time conversion clock according to claim 1, wherein said time conversion transmission means includes a conversion belt pulley set, said rotary input means including a relatively small driving pulley, said rotary output means including a relatively big driven pulley, and said coupling means, including a crossed belt in driving relationship with said pulleys, said transmission ratio of 0.5 being realized by said relatively big driven pulley having a circumference twice that of said relatively small driving pulley.

3. A time conversion clock according to claim 1, further including an indicator pin disposed between said dial plate and said time ring serving as an indication of relative setting of the latter with respect to the former, and wherein said time recording element is arranged for 24 hours recording.

4. A time conversion clock according to claim 1, wherein said time zone and at least said some of the world's regions are displayed on said time zone disc in a polar projection.

5. A time conversion clock according to claim 1, wherein the center of said rotary input means is spaced at a predetermined distance from the center of said rotary output means, said predetermined distance corresponding to a spacing of a center of said dial plate to a center of said time ring.

6. A time conversion clock, comprising in combination a case-like body portion, a time recording element disposed within said case-like body portion, an arbor and a first axle extending from said time recording element, and from said case-like body portion, respectively, said arbor being driven by said time recording element at a first rotation rate, and including a time hands set having an outer hour staff, an intermediate minute staff, and an inner seconds staff, said arbor having a relatively small pulley mounted thereon, a relatively large pulley being mounted on a second axle, said second axle being spaced from said arbor by a predetermined distance, coupling means including a crossed belt in driving relation with said pulleys for coupling said pulleys to one another, said large wheel rotating at a second rotation rate, the ratio of said first and second rotation rates being defined as a transmission ratio, said transmission ratio being 0.5, and being realized by said relatively large pulley having a circumference twice that of said relatively small pulley, time indication means coupled to said second axle, and including first and second hollow shafts, a rotary tape mechanism including an endless flat tape of a predetermined perimeter mounted on said hollow shafts, said second hollow shaft being operatively coupled to said second axle, said first hollow shaft being mounted on said first axle, said endless flat tape being formed with bilateral perforations on respective outer elongated portions thereof, a center endless elongated portion of said flat tape being continuous throughout said perimeter, having time-indicating numerals in ascending order labeled thereon, of which at least some are displayed outside of said body portion, said hollow shafts defining outer cylindrical surfaces, and having driving pins mounted on respective of said cylindrical surfaces for engagement with said bilateral perforations of said endless flat tape so as to cause the same to move upon rotation of said arbor, and a stationary universal time zone plate displaying at least some of the world's geographic regions in terms of stationary time zones corresponding thereto, said universal time zone plate being juxtaposed with said center endless elongated portion of said flat tape, whereby, when local time is shown on said time hands set, the time corresponding to the local time in a respective stationary time zone is displayed by a corresponding of said time-indicating numerals, when operatively moving, being juxtaposed with said respective time zone.

7. A time conversion clock according to claim 6, wherein said time recording element is arranged for 24 hours recording, and wherein said body portion is formed with a dial plate having an indication of 24 hours.

8. A time conversion clock according to claim 6, wherein said at least some of the world's regions are displayed in a Mercatur projection.

* * * * *